US011375811B2

(12) United States Patent
Chen et al.

(10) Patent No.: US 11,375,811 B2
(45) Date of Patent: Jul. 5, 2022

(54) RACK SYSTEM AND SLIDE RAIL MECHANISM THEREOF

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shun-Ho Yang, Kaohsiung (TW); Yao-Tsung Chen, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 67 days.

(21) Appl. No.: 16/883,127

(22) Filed: May 26, 2020

(65) Prior Publication Data

US 2021/0186213 A1 Jun. 24, 2021

(30) Foreign Application Priority Data

Dec. 23, 2019 (TW) ..... 108147487

(51) Int. Cl.
*A47B 88/47* (2017.01)
*A47B 88/477* (2017.01)
(Continued)

(52) U.S. Cl.
CPC ..... *A47B 88/477* (2017.01); *A47B 88/43* (2017.01); *A47B 88/46* (2017.01)

(58) Field of Classification Search
CPC ..... H05K 7/1489; H05K 7/183; A47B 96/07; A47B 88/477; A47B 88/43; A47B 88/46;
(Continued)

(56) References Cited

U.S. PATENT DOCUMENTS 5,734,557 A * 3/1998 McAnally ..... G11B 33/124 361/679.58
7,594,707 B2 * 9/2009 Kunkle ..... A47B 88/447 312/402
(Continued)

FOREIGN PATENT DOCUMENTS

DE 202015006279 U1 12/2016
EP 3315048 B1 5/2019
(Continued)

OTHER PUBLICATIONS

EP Search Report dated Feb. 1, 2021 for EP Application No. 20179444.3.

*Primary Examiner* — Ko H Chan
(74) *Attorney, Agent, or Firm* — Rosenberg, Klein & Lee

(57) ABSTRACT

A slide rail mechanism includes a rail, a movable member, a buffer member, and an elastic member. The movable member can be displaced with respect to the rail. The buffer member is provided on one of the rail and the movable member and can produce a buffering effect in response to the movable member being displaced in a certain direction. The rail includes a longitudinal wall and a supporting portion connected to the longitudinal wall. The longitudinal wall and the supporting portion jointly define a supporting path.

16 Claims, 8 Drawing Sheets

(51) Int. Cl.
*A47B 88/43* (2017.01)
*A47B 88/46* (2017.01)

(58) Field of Classification Search
CPC ..... A47B 88/473; A47B 2210/0091; A47B 2088/76
See application file for complete search history.

(56) References Cited

U.S. PATENT DOCUMENTS

| | | | | |
|---|---|---|---|---|
| 7,980,640 | B2 * | 7/2011 | Yang | A47B 88/493 312/333 |
| 8,894,164 | B2 * | 11/2014 | Zimmer | A47B 88/467 312/333 |
| 8,939,525 | B1 * | 1/2015 | Chen | A47B 88/467 312/333 |
| 10,342,341 | B2 | 7/2019 | Chen et al. | |
| 10,376,055 | B2 * | 8/2019 | Chen | A47B 88/43 |
| 10,736,421 | B2 * | 8/2020 | Liao | A47B 88/49 |
| 2013/0147335 | A1 * | 6/2013 | Chung | F25D 25/024 312/334.47 |
| 2014/0294328 | A1 * | 10/2014 | Pecar | A47B 88/40 384/20 |
| 2017/0303426 | A1 * | 10/2017 | Chen | A47B 96/07 |
| 2018/0168341 | A1 * | 6/2018 | Chen | A47B 88/427 |
| 2018/0306236 | A1 * | 10/2018 | Liu | A47B 88/49 |
| 2019/0090636 | A1 * | 3/2019 | Rehage | E05F 3/00 |

FOREIGN PATENT DOCUMENTS

| | | |
|---|---|---|
| TW | M493925 U | 1/2015 |
| TW | I517810 B | 1/2016 |

* cited by examiner

RACK SYSTEM AND SLIDE RAIL MECHANISM THEREOF

FIELD OF THE INVENTION

The present invention relates to a slide rail and more particularly to a slide rail mechanism that has a buffering function and can be used in a rack system.

BACKGROUND OF THE INVENTION

U.S. Pat. No. 9,867,462 B2 discloses a slide rail device in which a slide rail includes a supporting part and a side part. The supporting part is substantially perpendicularly connected to the side part and is configured to support an object. As shown in FIG. 18 and FIG. 19 accompanying the specification of this U.S. patent, the object can be pushed toward the slide rail in a certain direction (namely the second direction) and end up being supported by the supporting part of the slide rail.

Sometimes, however, the force applied by a user to the object in the aforesaid direction may be so large that the object is displaced too fast in that direction, and that in consequence the safety of use, if not the service life, of the slide rail or of the equipment mounted on the object is reduced. It is therefore important to develop a product different from the slide rail device disclosed in the aforecited patent.

SUMMARY OF THE INVENTION

One objective of the present invention is to provide a slide rail mechanism that has a buffering function.

Another objective of the present invention is to provide a slide rail mechanism that has a buffering function and can be used in a rack system.

According to one aspect of the present invention, a slide rail mechanism includes a rail and a buffer device. The buffer device is provided on the rail and includes a base, a movable member, and a buffer member. The movable member can be longitudinally displaced with respect to the base. The buffer member is configured to produce a buffering effect in response to displacement of the movable member in a first direction.

Preferably, the rail includes a longitudinal wall and a supporting portion substantially perpendicularly connected to the longitudinal wall, and the longitudinal wall and the supporting portion jointly define a supporting path.

Preferably, the rail is provided with a front bracket adjacent to a front end thereof, and the front bracket is configured to mount the rail to a front post of a rack.

Preferably, the rail is provided with a rear bracket adjacent to a rear end thereof, and the rear bracket is configured to mount the rail to a rear post of the rack.

Preferably, the buffer device is provided adjacent to the rear end of the rail.

Preferably, the movable member includes a contact portion corresponding to the supporting path.

Preferably, the contact portion extends beyond the rear end of the rail

Preferably, the buffer member of the buffer device includes a first component and a second component that are movable with respect to each other.

Preferably, the slide rail mechanism further includes an auxiliary member connected to the rail. The auxiliary member has a connecting portion and an extension portion bent with respect to the connecting portion. The extension portion of the auxiliary member is substantially parallel to the supporting portion of the rail.

Preferably, the slide rail mechanism further includes an elastic member for applying an elastic force to the movable member, wherein the elastic force acts in a second direction.

According to another aspect of the present invention, a slide rail mechanism includes a rail, a movable member, a buffer member, and an elastic member. The movable member can be longitudinally displaced with respect to the rail. The buffer member is provided on one of the rail and the movable member and is configured to produce a buffering effect in response to displacement of the movable member in a first direction. The elastic member is configured to apply an elastic force to the movable member, wherein the elastic force acts in a second direction, which is the opposite direction of the first direction.

According to still another aspect of the present invention, a rack system includes a rack, a first rail, a second rail, and a buffer device. The rack has a first side and a second side. The first side of the rack is provided with a front post and a rear post. The second side of the rack corresponds to the first side of the rack and is also provided with a front post and a rear post. The first rail includes a front bracket and a rear bracket that are configured to be mounted on the front post and the rear post of the first side of the rack respectively. The second rail includes a front bracket and a rear bracket that are configured to be mounted on the front post and the rear post of the second side of the rack respectively. Each of the first rail and the second rail has a longitudinal wall and a supporting portion substantially perpendicularly connected to the longitudinal wall. The first rail and the second rail jointly define a supporting space therebetween for receiving an object. The buffer device is provided on at least one of the first rail and the second rail and includes a base, a movable member, and a buffer member. The movable member can be displaced with respect to the base and includes a contact portion corresponding to the supporting space. While the object is being pushed into the rack, the object is brought into contact with the contact portion of the movable member, and the buffer member produces a buffering effect in response to the movable member being displaced in a first direction, in order to decelerate displacement of the object in the first direction.

Preferably, the two buffer devices are provided adjacent to the rear end of the first rail and the rear end of the second rail respectively.

Preferably, the two buffer devices are provided adjacent to tops of the first rail and the second rail respectively, and the contact portions of the two movable members extend beyond the rear end of the first rail and the rear end of the second rail respectively.

DETAILED DESCRIPTION OF THE INVENTION

Figures 1, 2:
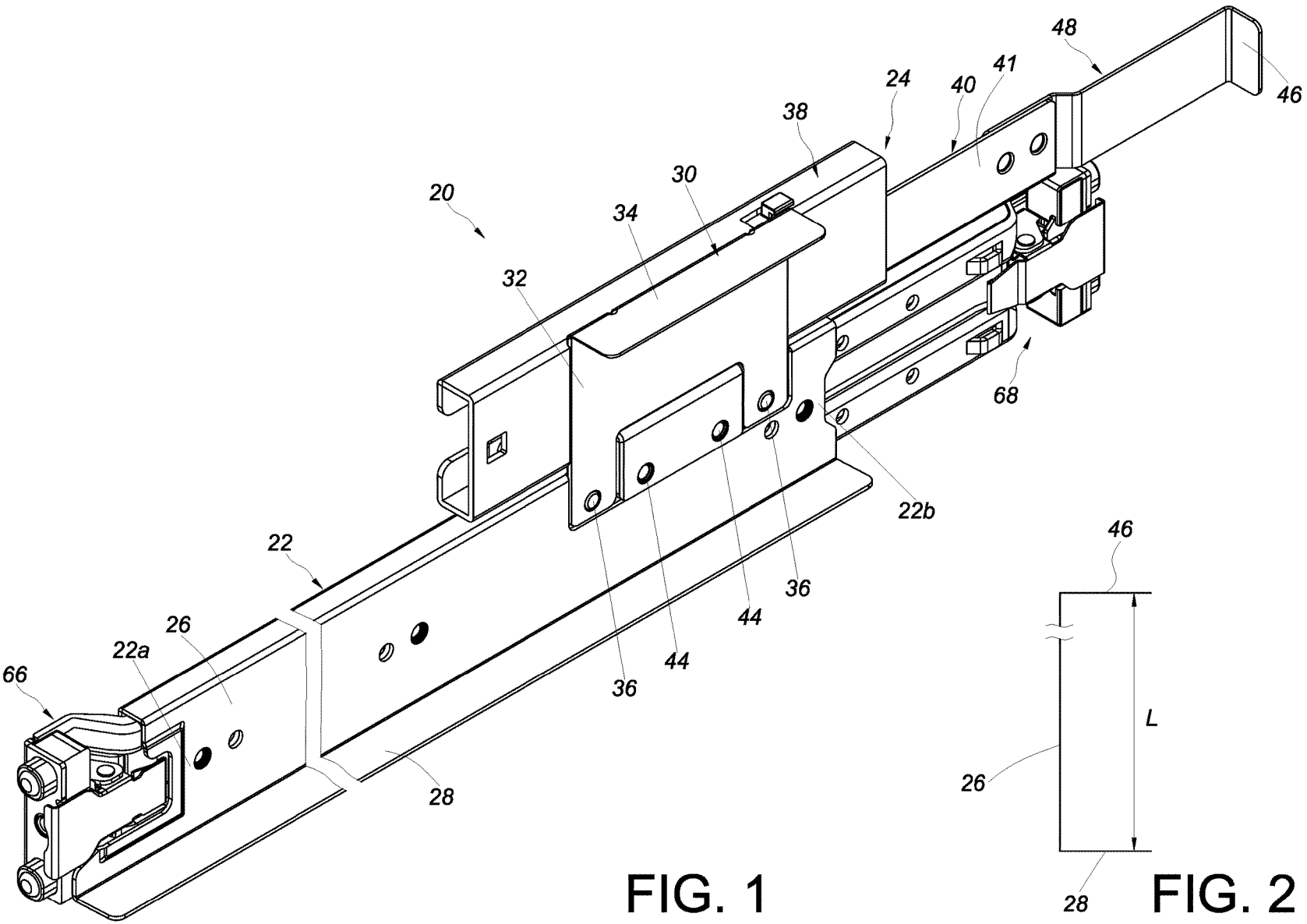
FIG. 1 is a perspective view of the slide rail mechanism according to an embodiment of the present invention.
FIG. 2 is a schematic view showing that a contact portion of the buffer device of the slide rail mechanism corresponds to a supporting path according to the embodiment of the present invention.
Figure 3:
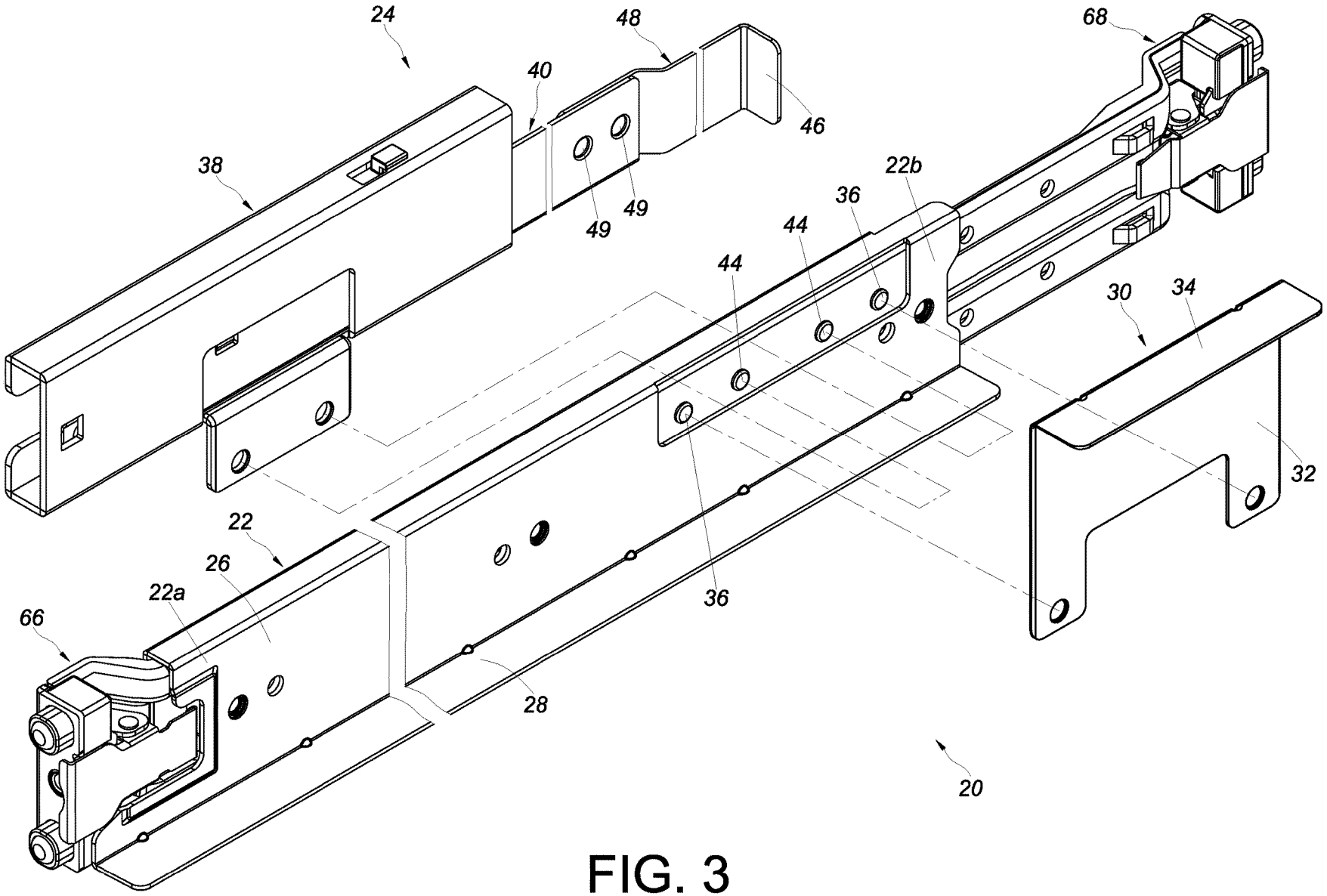
FIG. 3 is an exploded perspective view of the slide rail mechanism according to the embodiment of the present invention.

Referring to FIG. 1 to FIG. 3, the slide rail mechanism 20 according to an embodiment of the present invention includes a rail 22 and a buffer device 24.

The rail 22 includes a longitudinal wall 26 and a supporting portion 28. The supporting portion 28 is substantially perpendicularly connected to the longitudinal wall 26. The longitudinal wall 26 and the supporting portion 28 jointly define a supporting path L along which a bottom portion 74 and a side portion 78 of an object 72 can be supported (see FIG. 7). The supporting path L extends along the longitudinal direction of the rail 22.

The buffer device 24 is provided on the rail 22. Preferably, the slide rail mechanism 20 further includes an auxiliary member 30 connected to the rail 22. The auxiliary member 30 has a connecting portion 32 and an extension portion 34. The connecting portion 32 is connected (e.g., fixedly connected) to the longitudinal wall 26 of the rail 22 by at least one first connecting feature 36. The extension portion 34 is bent with respect to the connecting portion 32 and in this embodiment is substantially perpendicularly connected to the connecting portion 32 by way of example. The extension portion 34 of the auxiliary member 30 is substantially parallel to the supporting portion 28 of the rail 22.

As shown in FIG. 1 to FIG. 4, the buffer device 24 includes a base 38, a movable member 40, and a buffer member 42. The base 38 is connected (e.g., fixedly connected) to the longitudinal wall 26 of the rail 22 by at least one second connecting feature 44 and can therefore be viewed as a part of the rail 22. The movable member 40 can be longitudinally displaced with respect to the base 38. Here, by way of example, the base 38 includes a plurality of walls that jointly define a longitudinal channel 45, and the movable member 40 is movably mounted in the longitudinal channel 45 of the base 38. In other embodiments, one of the movable member 40 and the base 38 may include a longitudinal feature (e.g., a longitudinal hole or groove), and the other of the movable member 40 and the base 38 may include a connecting member extending through a portion of the longitudinal feature so as to make the movable member 40 longitudinally displaceable with respect to the base 38. The present invention has no limitation on the structural features used to enable such relative longitudinal displacement.

The movable member 40 includes a longitudinal main body 41 and a contact portion 46. The contact portion 46 corresponds to the supporting path L (see FIG. 2). Preferably, the contact portion 46 is perpendicularly bent with respect to the longitudinal main body 41. Here, the contact portion 46 is integrated with a contact member 48, and the contact member 48 is connected (e.g., fixedly connected) to the longitudinal main body 41 of the movable member 40 by at least one fixing feature 49 and can therefore be viewed as a part of the movable member 40.

Preferably, the buffer device 24 is provided adjacent to the rear end 22*b* of the rail 22 (see FIG. 1).

Preferably, the buffer device 24 is provided on top of and adjacent to the rail 22, and the contact portion 46 of the movable member 40 extends beyond the rear end 22*b* of the rail 22 (see FIG. 1).

Preferably, the buffer member 42 (see FIG. 4) is provided on one of the base 38 and the movable member 40. Here, the buffer member 42 is mounted on the base 38 by way of example; in other embodiments, the buffer member 42 may be mounted on the movable member 40 instead (not shown). The present invention has no limitation on whether the buffer member 42 is provided on the base 38 or the movable member 40.

Figures 4, 5:
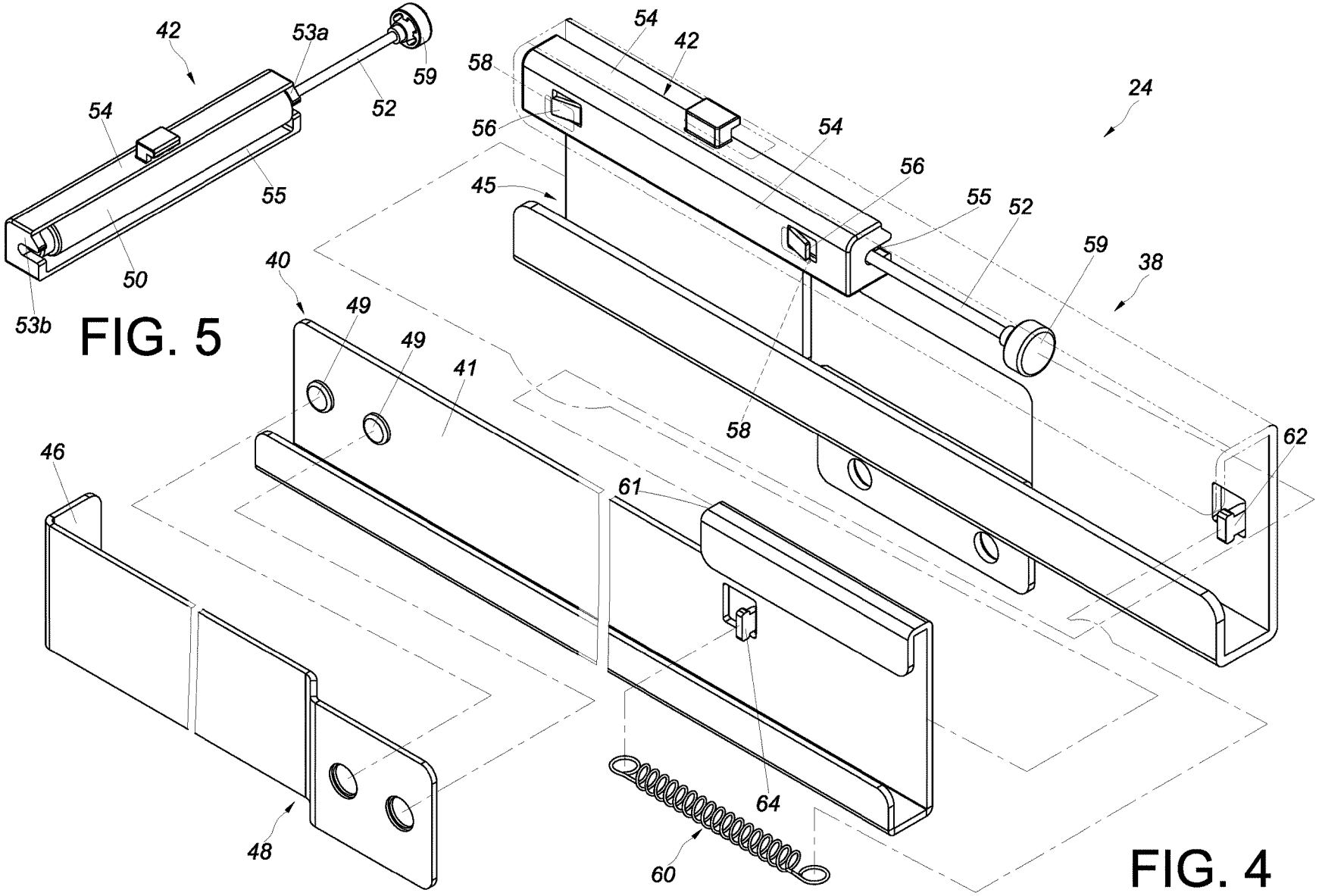
FIG. 4 is an exploded perspective view of the buffer device of the slide rail mechanism according to the embodiment of the present invention.
FIG. 5 is a perspective view of the buffer member of the buffer device according to the embodiment of the present invention.

The buffer member 42 includes a first component 50 and a second component 52 that are movable with respect to each other (see FIG. 4 and FIG. 5). Here, by way of example, the first component 50 is a cylinder while the second component 52 is a piston. More specifically, the first component 50 contains a buffer medium (e.g., a liquid or oil) and/or an elastic structure (e.g., a spring or other elastic element), and the second component 52 has a portion disposed in the first component 50 in such a way that the remaining portion (hereinafter referred to as the second portion) of the second component 52 remains jutting out of the first component 50, and hence in a buffer-ready state, in response to the force provided by the buffer medium. The principle of the buffering function of the buffer member 42 should be comprehensible to a person skilled in the art and, for the sake of brevity therefore, will not be detailed herein.

Preferably, referring to FIG. 4 and FIG. 5, the buffer device 24 further includes a mounting base 54. The mounting base 54 has a receiving space 55 for receiving the first component 50, and the first component 50 is blocked (or limited in position) between a first blocking wall 53*a* and a second blocking wall 53*b* of the mounting base 54. The second portion of the second component 52 is outside the receiving space 55 of the mounting base 54.

Preferably, the mounting base 54 has at least one mounting feature 56 (e.g., projection) to be mounted to the at least one corresponding feature 58 (e.g., hole or groove) of the base 38, so the buffer member 42 can be mounted on the base 38 through the mounting base 54.

Preferably, as shown in FIG. 4, the second component 52 has an abutting portion 59 corresponding to a contact end 61 of the movable member 40 (e.g., an end portion of a wall of the movable member 40). Here, by way of example, the abutting portion 59 and the contact end 61 are on substantially the same longitudinal level.

Preferably, the slide rail mechanism 20 further includes an elastic member 60 for applying an elastic force to the movable member 40. Here, by way of example, the elastic member 60 is a spring mounted between a first mounting portion 62 of the base 38 and a second mounting portion 64 of the movable member 40.

Figure 6:
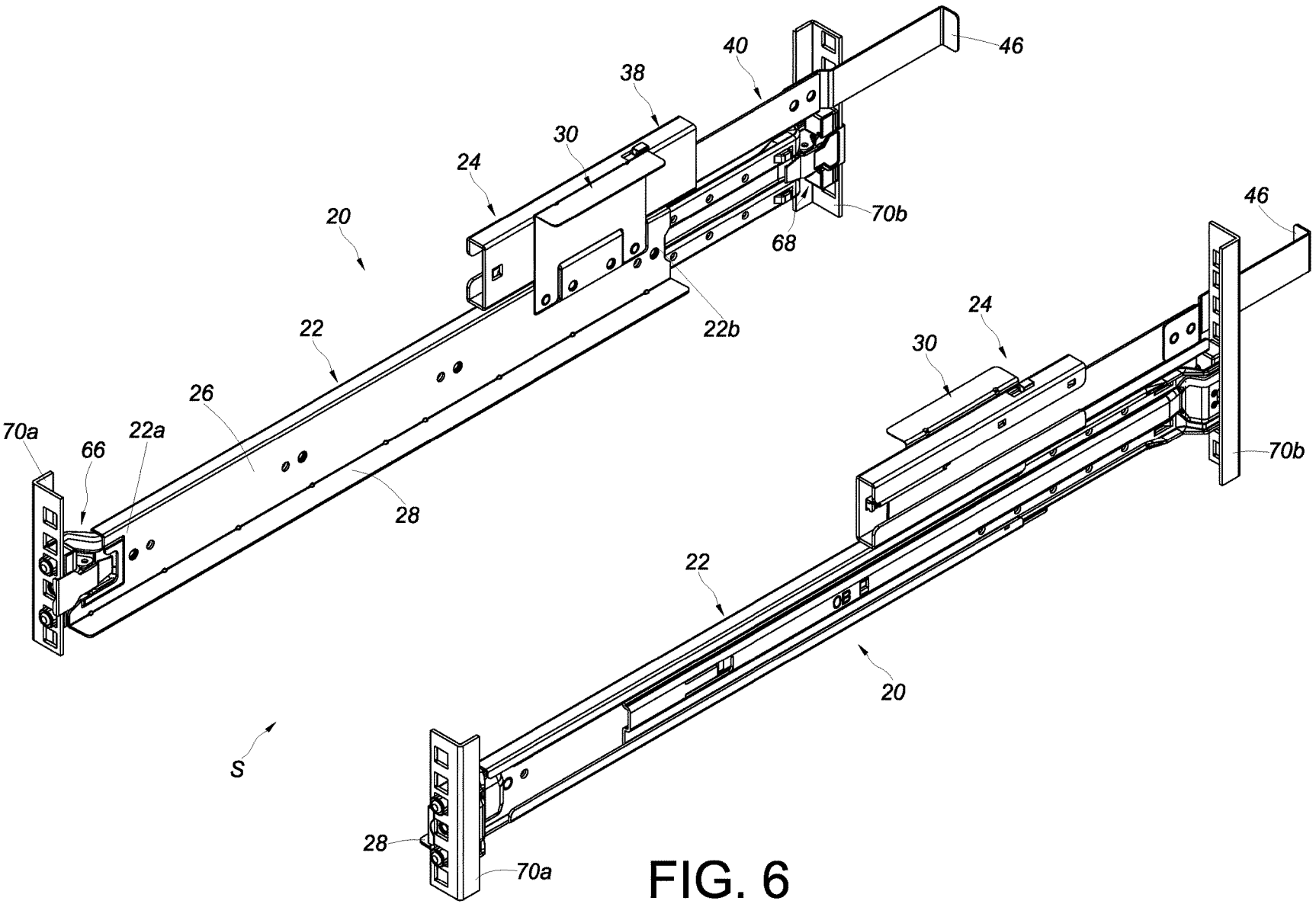
FIG. 6 is a perspective view showing that two slide rail mechanisms are mounted on a rack according to the embodiment of the present invention.

FIG. 6 shows a rack system in which two slide rail mechanisms 20 having substantially the same structural configuration are provided on a first side and a second side (e.g., the opposite left and right sides) of a rack respectively. The rail 22 of each slide rail mechanism 20 is provided with a front bracket 66 adjacent to the front end 22*a* and a rear bracket 68 adjacent to the rear end 22*b*. The front bracket 66 and the rear bracket 68 of each rail 22 are configured to mount the rail 22 to a front post 70*a* and a rear post 70*b* of the rack respectively. The rails 22 of the two slide rail mechanisms 20 (referred to in the appended claims as a first rail and a second rail) jointly define a supporting space S therebetween. The contact portion 46 of each movable member 40 corresponds to the corresponding supporting path L and therefore must correspond to the supporting space S.

Figure 7:
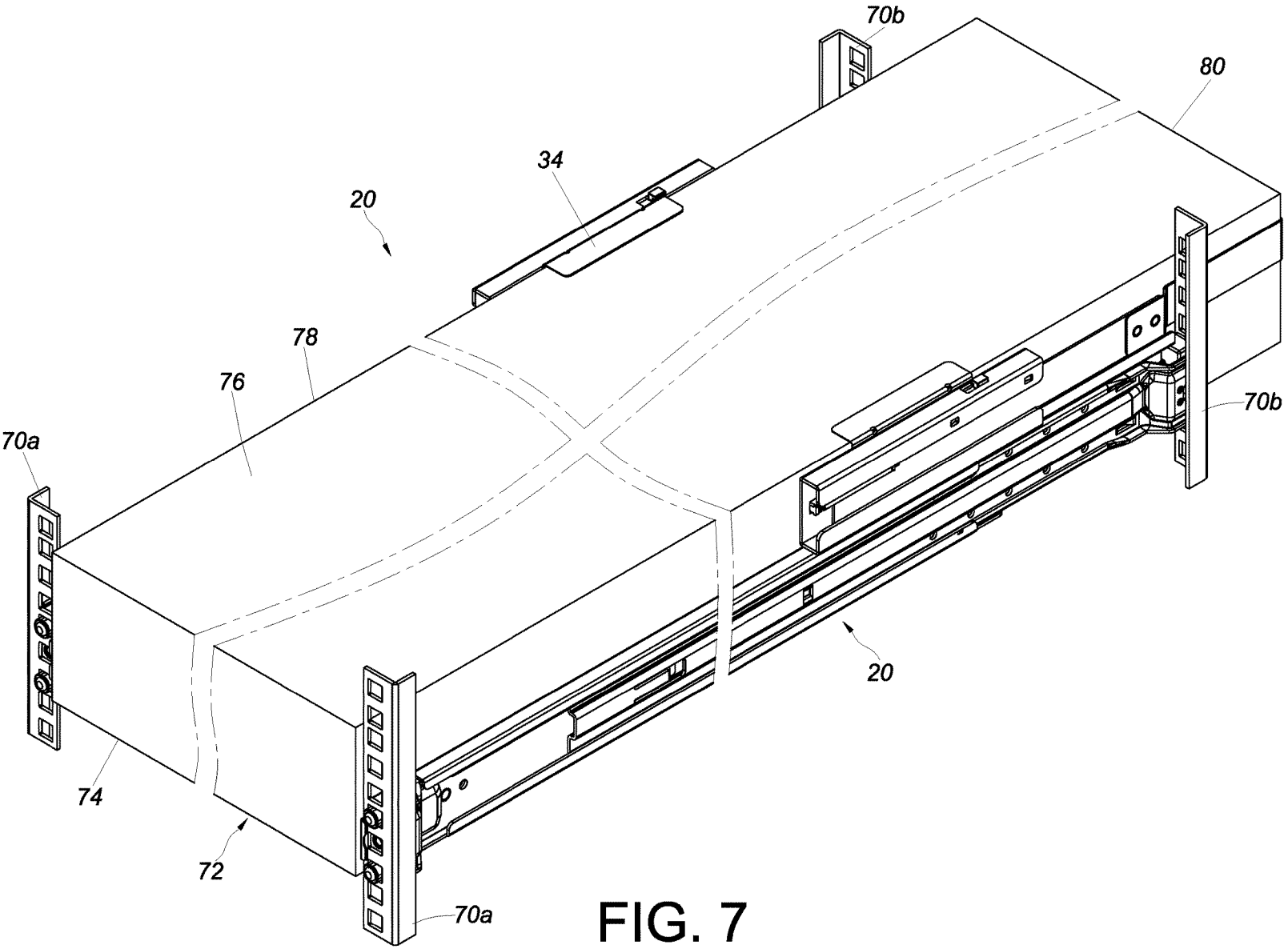
FIG. 7 is a perspective view showing that the two slide rail mechanisms mount an object on the rack according to the embodiment of the present invention.

As shown in FIG. 6 and FIG. 7, the object 72 can be received in the supporting space S and carried by the supporting portion 28 of the rail 22 of each slide rail mechanism 20. Preferably, the bottom portion 74 of the object 72 is supported by the supporting portions 28 of the rails 22 (referred to in the appended claims as the first rail and the second rail), and the top portion 76 of the object 72 is supported by the extension portions 34 of the auxiliary members 30. The side portions 78 of the object 72 may be supported by the longitudinal walls 26 of the rails 22 respectively.

Figure 8:
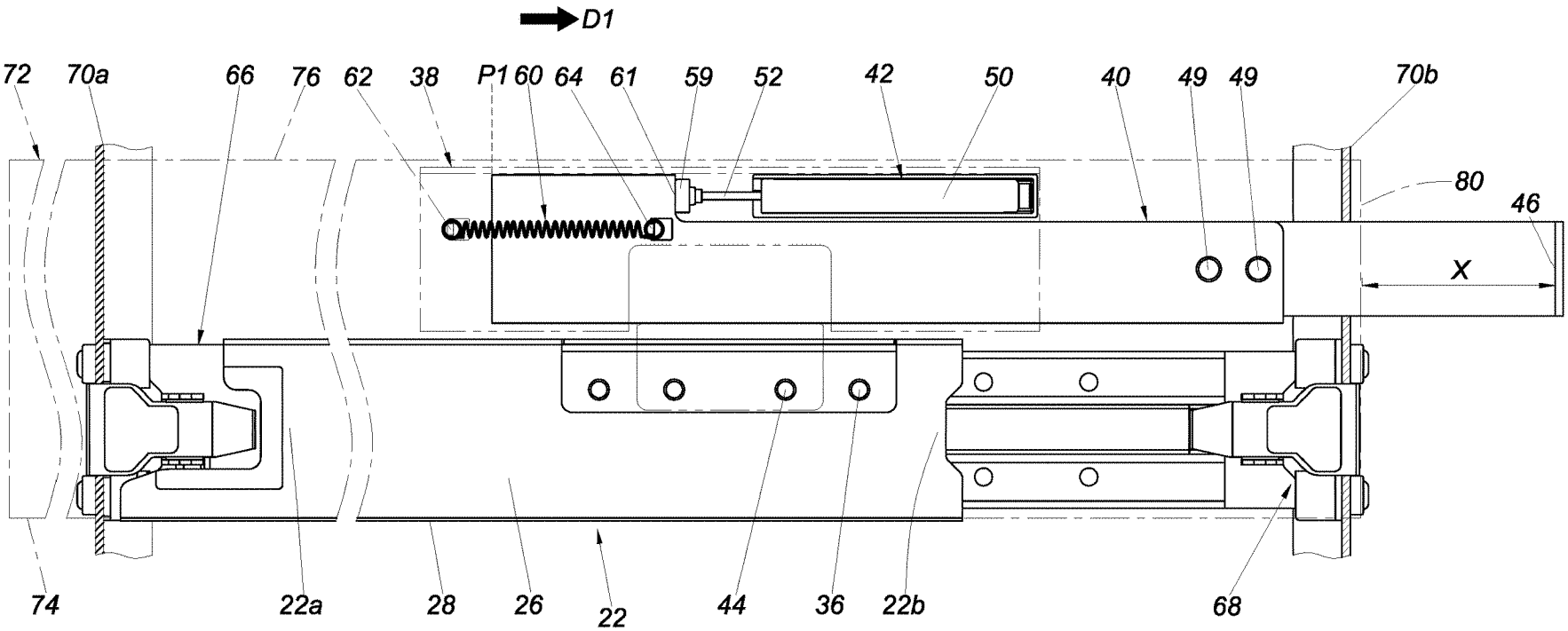
FIG. 8 is a schematic view showing that the object is pushed into the rack in a first direction according to the embodiment of the present invention.

Referring to FIG. 8, the rail 22 of the slide rail mechanism 20 is mounted on the front post 70*a* and the rear post 70*b* of the rack via the front bracket 66 and the rear bracket 68 respectively. There is a longitudinal distance X between a rear portion 80 of the object 72 and the contact portion 46 of the movable member 40. It is worth mentioning that the auxiliary member 30 is left out in FIG. 8.

Figure 9:
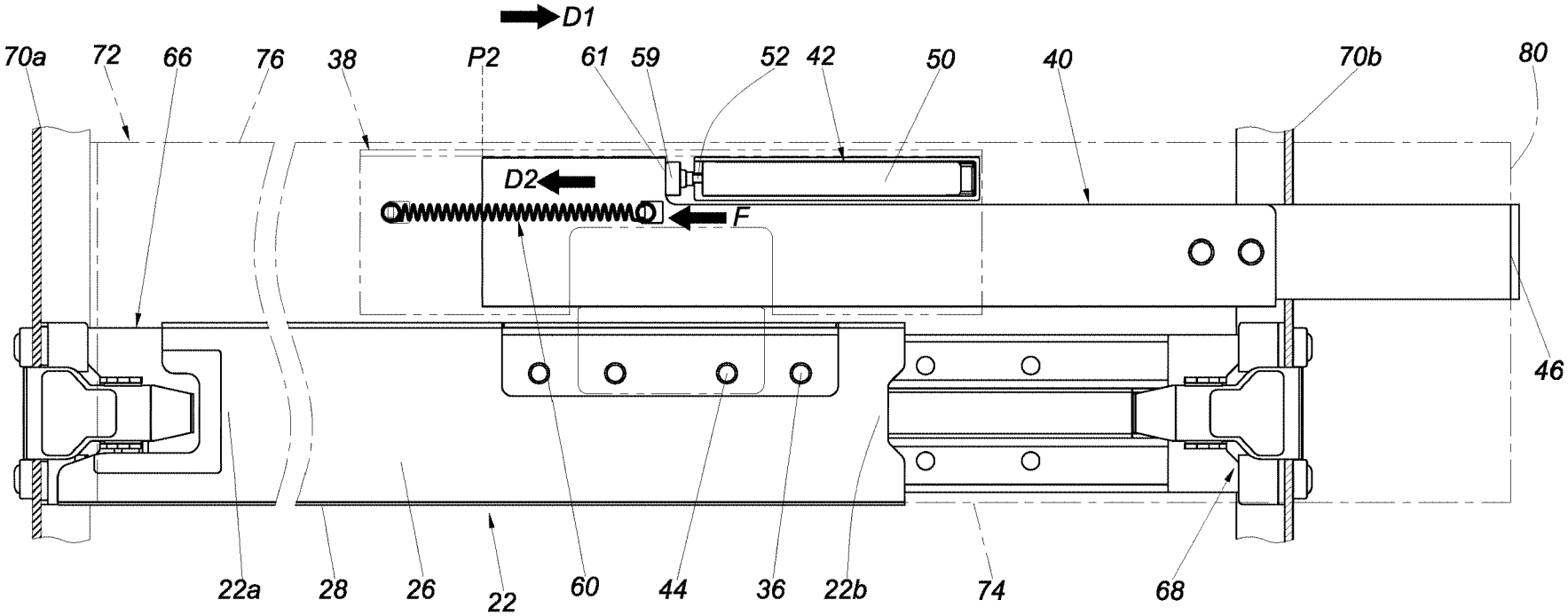
FIG. 9 is a schematic view showing that the object is further pushed into the rack in the first direction such that a movable member of the buffer device is displaced according to the embodiment of the present invention.

As shown in FIG. 8 and FIG. 9, the bottom portion 74 of the object 72 is supported by the supporting portion 28 of the rail 22. When the object 72 is subjected to an external force acting in a first direction D1 and is thereby pushed further into the rack, the rear portion 80 of the object 72 is brought into contact with the contact portion 46 of the movable member 40, and the buffer member 42 produces a buffering effect F (see FIG. 9) in response to the movable member 40 being displaced in the first direction D1. Consequently, the buffer member 42 reduces the speed at which the movable member 40 is displaced in the first direction D1, and thus effectively reduces the speed at which the object 72 is displaced in the first direction D1, too. While the movable member 40 is displaced from the first position P1 in FIG. 8 to the second position P2 in FIG. 9, the elastic member 60 stores an elastic force in response to the displacement of the movable member 40 in the first direction D1, wherein the elastic force acts in a second direction D2, which is the opposite direction of the first direction D1.

More specifically, once the rear portion 80 of the object 72 is in contact with the contact portion 46 of the movable member 40, the movable member 40 can be driven by the object 72 into displacement in the first direction D1 toward the second position P2, and during the process, the abutting portion 59 of the second component 52 will be pushed by the contact end 61 of the movable member 40, resulting in contraction of the second component 52 with respect to the first component 50. This contraction produces the buffering effect F (see FIG. 9), which decelerates the displacement of the object 72 in the first direction D1 or helps reduce the noise caused by collision between the rear portion 80 of the object 72 and the contact portion 46 of the movable member 40.

Figure 10:
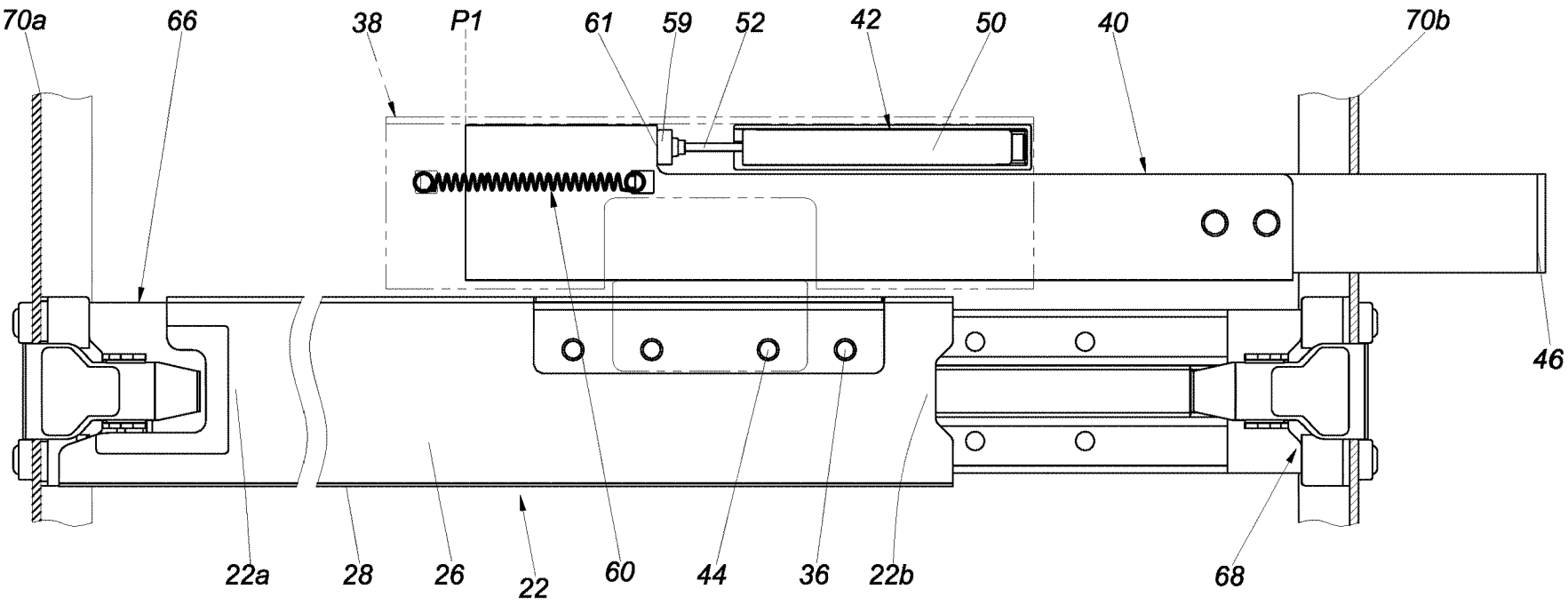
FIG. 10 is a schematic view showing that the movable member has returned to a predetermined position in response to an elastic member exerting an elastic force in a second direction according to the embodiment of the present invention.

As soon as the object 72 is displaced away from the contact portion 46 of the movable member 40 as shown in FIG. 10 (in which the object 72 has been detached from the rail 22 by way of example), the elastic member 60 releases the elastic force stored therein. The elastic force acts in the second direction D2 and thereby displaces the movable member 40 in the second direction D2, helping to bring the movable member 40 back to the first position P1 (see FIG. 10). In one preferred embodiment, the elastic force of the elastic member 60, which acts in the second direction D2, hardly produces any resistance to the force applied to displace the object 72 in the first direction D1; the elastic member 60 serves mainly to move the movable member 40 from the second position P2 back to the first position P1, i.e., the position where the buffer member 42 is ready for the next buffering operation. It should be pointed out that the buffer member 42 itself provides an elastic force that allows the second component 52 of the buffer member 42 to extend to the greatest extent with respect to the first component 50, and that the elastic member 60 in the embodiment illustrated herein is merely a preferred means to return the buffer member 42 to its initial working position rapidly. The elastic member 60, therefore, plays only an auxiliary role and is not essential.

In other words, when the object 72 is detached from the rail 22, or when the object 72 is displaced from the position shown in FIG. 9 in the second direction D2 by a distance equal to or larger than the distance between the second position P2 and the first position P1, the movable member 40 will return to the first position P1. It is worth mentioning that when the movable member 40 reaches the first position P1, the second portion of the second component 52 of the buffer member 42 protrudes as far from the first component 50 as in, and thus resumes, the buffer-ready state (see FIG. 10 or FIG. 8).

It can be known from the above that the technical feature of the slide rail mechanism 20 described herein consists in the buffer member 42 producing the buffering effect F when the movable member 40 is displaced in the first direction D1. The slide rail mechanism 20 is so designed that when displaced in the first direction D1, the object 72 carried by the rail 22 can push and displace the movable member 40 in the same direction, thus driving the buffer member 42 to exert the buffering effect F on the object 72; and that the elastic member 60 can apply to the movable member 40 an elastic force that acts in the second direction D2 (which is the opposite direction of the first direction D1) to help bring the movable member 40 from the second position P2 back to the first position P1, where the buffer member 42 is ready for the next buffering operation.

While the present invention has been disclosed through the preferred embodiments described above, the embodiments are not intended to be restrictive of the scope of the invention. The scope of the patent protection sought by the applicant is defined by the appended claims.

What is claimed is:

1. A slide rail mechanism, comprising:

a rail including a longitudinal wall and a supporting portion, wherein the supporting portion is substantially perpendicularly connected to the longitudinal wall, and the longitudinal wall and the supporting portion jointly define a supporting path; and a buffer device provided on the rail, wherein the buffer device includes a base, a movable member, and a buffer member, the movable member is longitudinally displaceable with respect to the base, and the buffer member is configured to produce a buffering effect in response to displacement of the movable member in a first direction, the movable member including a contact portion extending beyond a rear end of the rail.

2. The slide rail mechanism of claim 1, wherein the rail is provided with a front bracket adjacent to a front end of the rail and a rear bracket adjacent to a rear end of the rail, and the front bracket and the rear bracket are configured to mount the rail to a front post and a rear post of a rack respectively.

3. The slide rail mechanism of claim 2, wherein the buffer device is provided adjacent to the rear end of the rail.

4. The slide rail mechanism of claim 1, wherein the contact portion corresponds to the supporting path.

5. The slide rail mechanism of claim 4, wherein the buffer member of the buffer device includes a first component and a second component that are movable with respect to each other.

6. The slide rail mechanism of claim 1, further comprising an auxiliary member connected to the rail, wherein the auxiliary member has a connecting portion and an extension portion bent with respect to the connecting portion, and the extension portion of the auxiliary member is substantially parallel to the supporting portion of the rail.

7. The slide rail mechanism of claim 1, further comprising an elastic member for applying an elastic force to the movable member, wherein the elastic force acts in a second direction.

8. A slide rail mechanism, comprising:

a rail;

a movable member longitudinally displaceable with respect to the rail, the movable member including a contact portion extending beyond a rear end of the rail;

a buffer member provided on one of the rail and the movable member, wherein the buffer member is configured to produce a buffering effect in response to displacement of the movable member in a first direction; and an elastic member for applying an elastic force to the movable member, wherein the elastic force acts in a second direction, and the second direction and the first direction are opposite directions.

9. The slide rail mechanism of claim 8, wherein the rail defines a supporting path.

10. The slide rail mechanism of claim 9, wherein the rail includes a longitudinal wall and a supporting portion, the supporting portion is substantially perpendicularly connected to the longitudinal wall, and the longitudinal wall and the supporting portion jointly define the supporting path.

11. The slide rail mechanism of claim 8, wherein the rail is provided with a front bracket adjacent to a front end of the rail, and the front bracket is configured to mount the rail to a front post of a rack.

12. The slide rail mechanism of claim 11, wherein the rail is provided with a rear bracket adjacent to a rear end of the rail, and the rear bracket is configured to mount the rail to a rear post of the rack.

13. A rack system, comprising:

a rack having a first side and a second side, wherein the first side is provided with a front post and a rear post, the second side corresponds to the first side, and the second side is provided with a front post and a rear post;

a first rail including a front bracket and a rear bracket, wherein the front bracket and the rear bracket of the first rail are configured to be mounted on the front post and the rear post of the first side of the rack respectively;

a second rail including a front bracket and a rear bracket, wherein the front bracket and the rear bracket of the second rail are configured to be mounted on the front post and the rear post of the second side of the rack respectively, each of the first rail and the second rail has a longitudinal wall and a supporting portion substantially perpendicularly connected to the longitudinal wall, and the first rail and the second rail jointly define a supporting space therebetween for receiving an object; and two buffer devices respectively provided on the first rail and the second rail, wherein each buffer device includes a base, a movable member, and a buffer member, each movable member is displaceable with respect to a corresponding base, and each movable member includes a contact portion corresponding to the supporting space and respectively extending beyond a rear end of a corresponding one of the first rail and the second rail;

wherein while the object is being pushed into the rack, the object is brought into contact with the contact portion of each of the movable members, and the buffer members produce a buffering effect in response to displacement of the movable members in a first direction in order to decelerate displacement of the object in the first direction.

14. The rack system of claim 13, wherein the buffer member of each said buffer device includes a first component and a second component that are movable with respect to each other.

15. The rack system of claim 13, further comprising an auxiliary member connected to the first rail and an auxiliary member connected to the second rail, wherein each said auxiliary member has a connecting portion and an extension portion bent with respect to the connecting portion, and the extension portions of the two auxiliary members are substantially parallel to the supporting portion of each of the first rail and the second rail.

16. The rack system of claim 13, further comprising a pair of elastic members, each elastic member applying an elastic force to a corresponding one of the movable members, wherein the elastic force acts in a second direction, the second direction being opposite directions to the first direction.

* * * * *